United States Patent [19]

Napadow

[11] 4,207,833

[45] Jun. 17, 1980

[54] PROTECTED CONVEYOR SYSTEM

[75] Inventor: Stanley C. Napadow, Chicago, Ill.

[73] Assignee: Protectaire Systems Co., Chicago, Ill.

[21] Appl. No.: 973,946

[22] Filed: Dec. 28, 1978

[51] Int. Cl.[2] ..... B05B 15/04

[52] U.S. Cl. ..... 118/324; 98/115 SB; 118/326; 118/634; 118/DIG. 7; 198/678

[58] Field of Search ..... 118/324, 326, 634, DIG. 7; 198/678; 98/115 SB

[56] References Cited

U.S. PATENT DOCUMENTS

| | | | |
|---|---|---|---|
| 2,119,282 | 5/1938 | Ludwig | 98/115 SB |
| 3,563,203 | 2/1971 | Stiltner | 118/324 |
| 3,749,229 | 7/1973 | Napadow | 198/866 X |
| 4,048,912 | 9/1977 | Walker | 118/634 X |

*Primary Examiner*—Evan K. Lawrence

*Attorney, Agent, or Firm*—Fitch, Even & Tabin

[57] ABSTRACT

A protected conveyor for a spray chamber or spray booth is provided with a pressurized housing and an air curtain means which substantially isolates the conveyor from the deleterious fluids within the spray booth and substantially isolates the articles from droppings from the conveyor. More specifically, a blower supplies air under pressure to a plenum connected to a nozzle means which discharges a thin curtain of air transversely across a slot in the housing wall and transversely across depending conveyor hangers extending downwardly through the slot. The blower also supplies air under pressure to the housing to provide air discharge out of the housing slot. The transverse air discharge combines with and redirects the air discharge through the slot as common continued air movement transversely away from the conveyed articles and toward an external air exhaust from the booth. The housing, conveyor and air curtain means are formed in an inexpensive manner.

17 Claims, 4 Drawing Figures

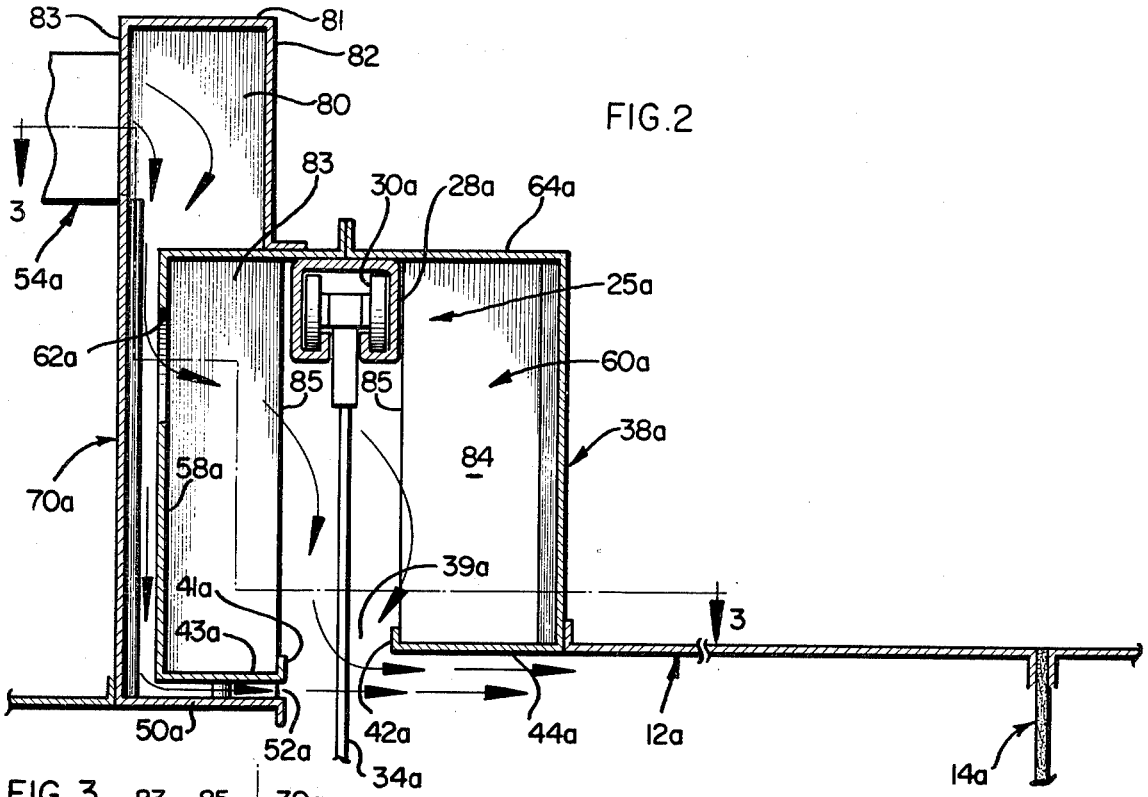
FIG. 2
FIG. 3
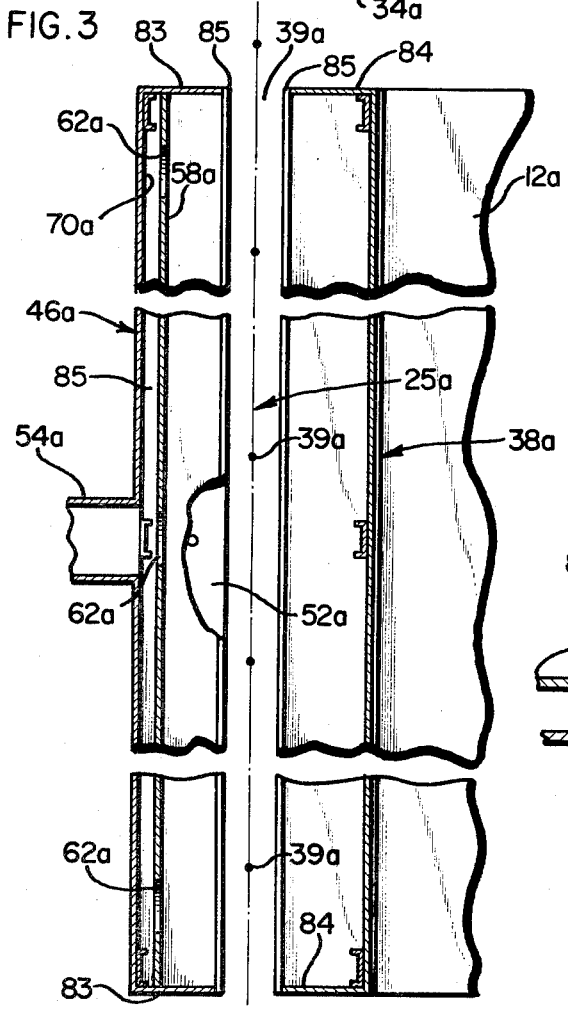
FIG. 4
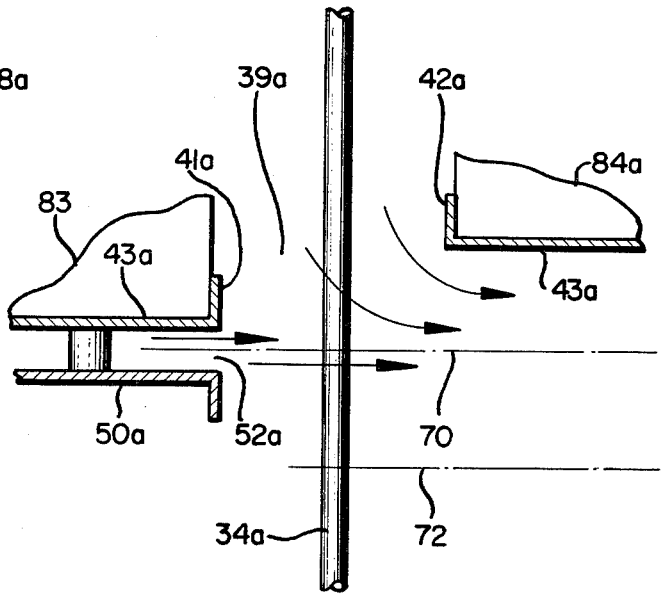

PROTECTED CONVEYOR SYSTEM

BACKGROUND OF THE INVENTION

This invention relates to protecting conveyors carrying articles through deleterious atmospheres within chambers or booths such as spray booths.

In many industrial applications, the atmosphere within the spray booth and to which the conveyor is subjected is quite corrosive or contaminated and thus capable within a very short time of binding the moving support and drive components of the conveyor thereby dramatically increasing the power required to operate the conveyor. This of course can cause ultimate conveyor breakdown, which is quite costly both from the standpoint of the necessary repairs that must be made as well as from the loss in production during the conveyor down time, should such a conveyor be used in an assembly line.

Efforts to overcome this problem and maintain the conveyor and its moving components in a cleaner atmosphere have resulted in the shrouded and pressurized conveyor such as shown in U.S. Pat. No. 3,563,203 which discloses a conveyor having an essentially fluid impervious shroud means that substantially encloses the conveyor except for a continuous slot that parallels the support means through which the hangers fit or extend. Blower means are used to force air into and pressurize the shroud means enclosure, as compared to the atmospheric pressures ambient the shroud means. A flexible seal is used adjacent the slot to embrace the hangers and thereby generally maintain the shroud means enclosure airtight. The superatmospheric pressure in the shroud means enclosure thereby precludes the inward migration of outside atmospheric fluids and thereby maintains the moving components of the conveyor generally clean. The drawbacks of this system are apparent however in that the seal is constantly flexed by the moving hangers, which seal thus frequently fails and further which dramatically increases the conveyor drag and thus the needed input power to move the conveyor. Further, in certain atmospheres, such as in a spray chamber apparatus for paint or other coatings, the seal itself becomes loaded with the unwanted environmental fluids or paint particles which can fall onto the conveyed articles therebeneath on the conveyor hangers.

In U.S. Pat. No. 3,749,229, the flexible seal adjacent the slot was eliminated and pressurized fluid prevented unwanted environmental fluids into the shroud enclosure and the possible contact then with the moving conveyor components. However, in certain applications of this system, the pressurized fluid discharge is downwardly toward the conveyed articles on the hangers. Thus, the downward directional discharge of air onto the conveyed articles, if of sufficient velocity, can cause rippling of the uncured paint, even though the air itself is entirely pure or without suspended particles therein of appreciable size. Also, other industrial applications of shrouded and pressurized conveyor means find that the directional air discharge from the conveyor shroud enclosure toward or against the underlying conveyed articles is undesirable, particularly if the articles are close to the slot when being sprayed. Also, accumulation of dried particles, such as paint, on the conveyor parts may interfere with a good grounding of the parts passing through an electrostatic paint spray booth.

SUMMARY OF THE INVENTION

This invention provides improved conveyor shrouding structure which keeps deleterious environmental fluids from the conveyor means and from collecting thereon.

This invention specifically provides for the use of a directional discharge of air or fluid transversely of or crosswise of the hangers extended through the hanger slot of the conveyor shrouding and across the hanger slot, that is, from one edge of the slot generally toward the opposite edge of the slot, which transverse discharge is of sufficient velocity and volume to admix with and redirect air discharge from the conveyor shrouding through the slot for common continued movement in a direction generally transversely of the hangers and the underlying conveyed articles.

This invention is ideally suited for use within a spray chamber apparatus, where this transverse directional discharge is not only crosswise of the conveyor hangers and the conveyed articles but also is in a direction toward exhaust means typically provided in such apparatus for removing unwanted environmental fluids from within the spray chamber apparatus.

BRIEF DESCRIPTION OF THE DRAWINGS

FIG. 2 is a sectional view similar to FIG. 1 except showing an alternate embodiment of the improved conveyor protection apparatus of this invention;

FIG. 3 is a sectional view of a portion of the apparatus illustrated in FIG. 2 and as seen generally from line 3—3 in FIG. 2; and FIG. 4 is an enlarged sectional view of pertinent portions of the apparatus illustrated in FIGS. 1, 2 and 3.

DETAILED DESCRIPTION OF THE INVENTION

Figure 1:
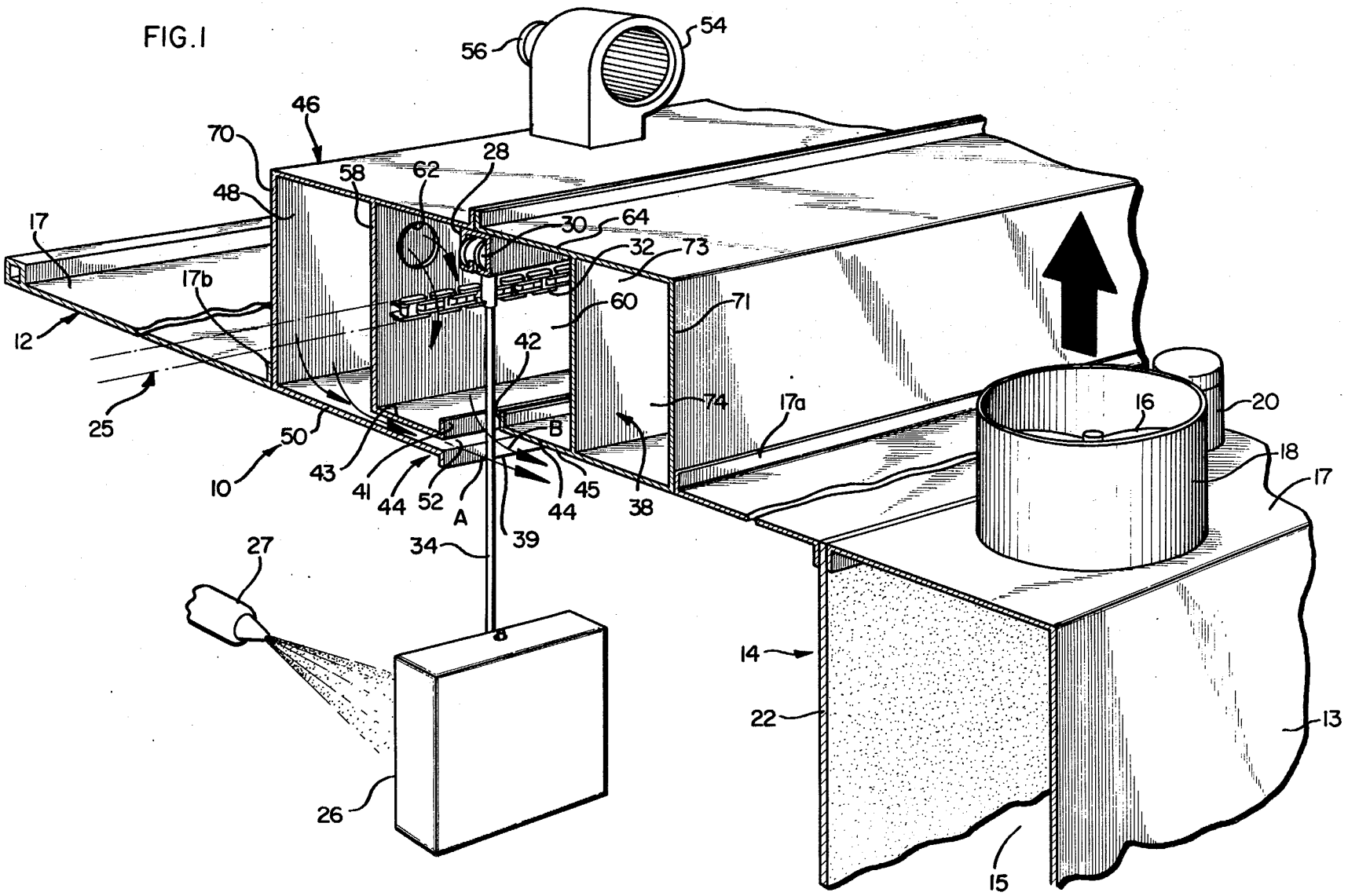
FIG. 1 is a perspective view, shown in broken away cross section, of a spray chamber installation having one embodiment of improved conveyor protection apparatus of this invention associated therewith.

As shown in the drawings for purposes of illustration, the invention is embodied in an apparatus for protecting a conveyor means 25 which has a projecting portion 34 such as a hanger for conveying articles 26 along a path of travel through a spray booth or protective chamber 10 within which the articles is treated by means such as an electrostatic paint spray gun 27. Typically, the protective booth 10 is an elongated building-like structure having vertical side walls 13, a top wall 17 and end walls (not shown) to enclose and contain the deleterious fluid usually containing excessive amounts of sprayed liquid, liquid vapor, or airborne particles such as paint.

A fluid exhaust system 14 for withdrawing environmental fluids within the confines of the chamber includes a collection manifold space 15 extending along one side of the spray chamber 16 located in an exhaust duct 18 which is connected by a pipe (not shown) to an external air exhaust. A motor 20 typically powers the exhaust fan 16. A cleaning system 22 can be included between the hood confines and the exhaust system duct located generally within the manifold space to remove the bulk of the impurities in the exhausted deleterious fluids before discharging the cleaned fluids. The illustrated cleaning system is in the form of removable fiber arrestor pads which serve as filters through which the exhausted fluids pass; however, water wash or spray wash systems can readily be used instead of the pads.

Typically, these spray chambers 10 are formed with an elongated opening in the top wall or roof 17, as defined by upturned flanges 17a and 17b which extend longitudinally of the spray chamber and define therebetween a predetermined width, e.g., 12 to 36 inches, into which is fitted a protected conveyor apparatus, which may be sold and installed separately from the remainder of the spray booth. In other instances (not shown), the protected conveyor apparatus may be built into the booth itself. Also, the conveyor means 25 may be actually built within a protected shrouding or housing means 38, as illustrated herein, or the conveyor may be separately supported above the shrouding by supports, not shown herein.

The conveyor means 25 may be of various configurations and the illustrated configuration comprises an elongated channel or beam support 28, rollers 30 connected to ride axially along the support, and a flexible chain 32 or the like which interconnects the rollers and extends axially along the support. An appropriate drive (not shown) powers the chain and thereby moves the chain and rollers axially along the support. Typically, the support and chain are endless, in the forms of continuous loops (not shown), which therefore allows unidirectional movement of the conveyor. The projecting conveyor portions 34 extending into the deleterious fluid, hereinafter called "hangers", are secured to certain of the rollers at spaced intervals along the length of the chain and each article to be conveyed is thereby hung from the lower extremity of the hanger typically at a distance considerably spaced from the conveyor support 28.

In the area of the spray chamber, the conveyor components, except for the lower portions of the hangers 34, are located in the housing means 38 of fluid-impervious sheet metal or plastic that generally surrounds the conveyor except for an elongated continuous slot 39 defined between adjacent longitudinally extending edges 41 and 42, respectively, on lower or bottom shrouding walls 43 and 44. The conveyor hangers 34 extend through the shrouding slot 39 and thereby provide lower exposed portions on which the articles can be carried.

While it has been heretofore known, to pressurize the hollow interior chamber 60 in the housing means 38 with a non-deleterious fluid, such as clean air, and to provide a barrier means, such as the flanges 41 and 42, to reduce the air flow rate through the slot 39, there nonetheless still occurred, in some instances, too great a downward flow of air which could disturb the painting or other spraying operations on the articles 26. In other instances, some liquid drops or foreign particles also dropped from the conveyor down onto the articles 26. While the air barrier formed by pressurizing the chamber 60 was generally effective, there was room for improved protection of the conveyor means.

In accordance with the present invention, particles dropping from the conveyor means in the housing chamber 60 are carried laterally away from the article 26 and likewise rising airborne particles are carried laterally away from the chamber 60 by a protective fluid curtain means 44 which directs a lateral air flow across the slot 39. Herein, the fluid curtain means 44 comprises an air discharge slot or nozzle 52 which discharges high velocity air laterally, as shown by the arrow A in FIG. 1, and which has sufficient velocity to deflect the downward flow of air, as indicated by the curved arrow B, from the housing means chamber 60 in a lateral direction, and preferably toward the discharge means 14. Thus, a laterally flowing sheet of clean fluid flowing across the slot 39 cooperates with the pressurized clean fluid flowing down from the housing chamber 60 to protect the conveyor means 25 from the deleterious fluid.

Also, as will be explained in greater detail, the housing means 38, the fluid curtain means, and a means 50 for pressurizing the housing conveyor chamber 60 are formed in a novel and low-cost manner. The manner of construction and the cost thereof are of particular importance to industries, such as the automobile or farm machinery industries, which have extremely long cleaning, paint preparation, painting, and drying operations in a long continuous line. Also, in such operations, the damage to a paint finish by foreign particles can be very expensive to repair. The cost of the apparatus is reduced herein by using a bottom wall 50 of the housing means to form one side of the fluid curtain means, as well as forming the slot 39 and to use a common wall 58 of the housing means as a side wall of a fluid distribution passage or plenum 48 as well as a side wall for the conveyor chamber 60, as will be explained in greater detail. Herein, the fluid curtain discharge from the nozzle 52 is offset vertically in a downward direction from the opposite bottom housing wall 44 so that the fluid traveling laterally sweeps along underside 45 of the wall 44. The plenum 48 opens between an upper housing wall 43 and a bottom wall 50 to an elongated generally continuous narrow outlet 52 located adjacent one side edge 41 of the slot 39.

A blower 54 having an outlet connected to the housing plenum and powered by an electric motor 56 is adapted to force air into the plenum 48. This pressurized air thereby escapes through the fluid curtain discharge nozzle 52 in the form of a generally continuous thin curtain of air directed crosswise or transversely of the shrouding slot 39. The plenum 48 has at least one opening 62 in its side wall 58 discharging clean fluid from outside the confines of the spray chamber hood to within the shrouding enclosure. Inasmuch as wall 58 is also common to the pressurized plenum 48, the air is supplied under a positive pressure to within the shrouding enclosure, and is discharged from the shrouding enclosure through the shrouding slot 39.

Herein, the outlet defining walls 43 and 50 are parallel to one another, are spaced apart between $\frac{1}{4}$ and $\frac{3}{4}$ of an inch, and face one another throughout a distance of approximately between three to six times this width. The illustrated shrouding slot is approximately between 1 and 5 inches in width. The curtain of air from the outlet is of sufficient velocity and volume to combine or admix with and to redirect the air discharge from the slot 39 for common continued movement generally away from the outlet and toward the exhaust system manifold space 15. This curtain of air and the combined air movement being directed transversely of the hangers and of the conveyed articles thereby avoids the conveyed articles. The outward flow of air from the shrouding enclosure through the slot 39 precludes the environmental fluids located within the confines of the booth and ambient the articles from entering the enclosure and contacting the conveyor support, roller or chain means. In typical application, only approximately five to twenty-five percent of the air output from the blower is admitted into the housing chamber 60, and the remaining air is used to form the curtain of air flowing from the nozzle 52.

The illustrated housing means 38 spans the entire length of the spray chamber and has open ends at least in the areas where the conveyor support, rollers, chain and hanger components pass through, although the other areas of the ends are preferably closed by shrouding walls in order to minimize unwanted outward escape of air or inward migration of environmental fluids. End walls (not shown) close the ends of the plenum to preclude unwanted release of the pressurized supplied air.

In a typical spray chamber installation, the bulk of the paint spray is generated at a central location rather than at one end of the spray chamber so that preferably the fluid flow rate and the air curtain provided thereby are generally highest above the centrally located spraying location. Thus, it is preferred to locate the blower at a central location over the spray location so that the air flowing from the center of the nozzle 52 is at the highest velocity with reduced flow rates being experienced at the ends of the nozzle 52 where the hangers 34 enter and exit the booth. By way of example, in the illustrated embodiment of FIG. 1, an air discharge velocity of 800 cubic feet per minute from the nozzle 52 at central area of the chamber 60 produced a good air curtain with the air velocity decreasing to about 400 cfm at the ends of a 10-foot long booth. Herein, the slot 39 is only three inches in width. In the plane of the nozzle, the air flow rate at the center of the booth dropped from 800 cfm to 200 cfm at a distance of 3 feet and 8 inches from the nozzle 52.

Herein, the slot defining edges 41 and 42 of the housing means are vertically spaced by about 1.5 inches. The overall width of the housing means is about 21 inches between outer vertical side walls 70 and 71 of the housing means. Herein, the plenum 48 is about six inches in width. The overall height between top wall 64 and bottom wall 50 for the illustrated housing means is 14 inches.

Preferably, a longitudinally extending divider wall 73 extending parallel to the outer housing wall 71 adds rigidity to the housing means and forms a dead air space 74 on the side opposite the plenum 48.

A slim-line embodiment of the invention is shown in FIGS. 2 and 3 in which the width of housing means has been substantially reduced, for example, from about 21 inches to 9 inches in width. A suffix "a" has been added to all reference characters heretofore used to designate elements which are substantially the same in both the FIGS. 1 and 2 embodiments.

Air from blower **54*a* flows into an enlarged overhead plenum 80 which is located on top of the housing means top wall 64*a*. The plenum 80 is formed with a top wall 81 and a pair of depending side walls 82 and 83 with the outlet of the blower 54*a* being disposed centrally of the housing means 38*a*, as best seen in FIG. 3. A narrow air flow passage 85 extends downwardly from the plenum 80 and is defined on opposite sides by vertically extending housing walls 58*a* and 70*a*. A series of ports 62*a* in the form of circular holes in the wall 58*a* allow some of the pressurized air to flow into the chamber 60*a* in which is located the conveyor means 25*a*. As illustrated by the directional arrows, the pressurized clean fluid in the chamber 60*a* may flow down through the slot 39*a* and prevent ingress of the deleterious fluids from flowing upwardly into the chamber. The higher velocity fluid flowing through the nozzle 52*a* which is defined by spaced horizontal plates 43*a* and 50*a* forms the fluid curtain to divert the downward flowing air laterally across the underside of the housing bottom wall 44*a*, as indicated by the directional arrows in FIG. 2. Thus, it will be seen that the FIGS. 2, 3 and 4 slim-line embodiments operate substantially in the same way as the FIG. 1** embodiment.

It will be appreciated that the direction and location of the transfer flow from the fluid curtain means may be changed and that a series of spaced, discrete nozzles may be used in lieu of the single nozzle and still fall within the purview of the invention as defined by the appended claims. Likewise, the particular configuration of the housing means and the air carrying ducts, passageways or plenums may be changed and fall within the ambit of the claims of this invention. Moreover, the conveyor projecting portion may be upright pushers rather than depending hangers with the fluid curtain being located at the bottom of the booth to prevent drops from dropping down into an underlying conveyor; and still be covered by the appended claims. The preferred form, however, has advantages in that it is economical, fits easily into an open slot often provided for conveyors, and can be readily fabricated on site or at the location of manufacture of the spray booth.

Further, it is to be understood that the location of the blower can be varied, as is its manner of connection with the housing plenum. Of importance only is the use of clean air or fluid that will not itself contaminate the conveyor. For this reason, the blower inlet must be located remotely of the hood confines and thus not itself take in contaminated or environmental fluids. Thus, it is common to locate the blower remotely of the spray chamber installation but it can be even on the roof of the spray hood. Further, filters (not shown) can be used across the inlet of the blower to remove impurities or suspended particles in the air prior to being forced through the plenum and outlet and in the manner noted herein.

Similarly, the location of the exhaust outlet fan and motor can be in the immediate vicinity of the plenum or can be located remotely thereof and even on the roof of the building within which the spray chamber installation is located, and duct work merely connect the hood to the fan.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. For use with a conveyor having conveyor means for carrying articles through a path inside a booth where the articles are treated and in which are deleterious fluids or airborne particles, said booth having a wall with a longitudinally extending slot therein through which projects a portion of said conveyor means for transporting said articles, a tunnel housing means substantially surrounding said conveyor means and said slot through which said portion of said conveyor means projects for travel longitudinally along said slot, means for introducing non-deleterious fluid into tunnel housing means under a pressure greater than the pressure of the deleterious environmental fluids to discharge a portion of said non-deleterious fluid through said slot; so as to inhibit the flow of said deleterious fluids into said tunnel housing means and into contact with the remainder of said conveyor means, and air curtain means for discharging a stream of non-deleterious fluid transversely across said slot and said projecting conveyor portion and longitudinally along said slot for redirecting said discharge of non-deleterious fluid from said articles and to provide a fluid curtain means across said slot against flow of said deleterious fluid and airborne particles into said conveyor means.

2. An apparatus in accordance with claim 1 in which said air curtain means for discharging a stream of non-deleterious fluid across said conveyor projecting portion comprises duct means offset vertically from said slot in the direction toward said articles, and in which a common plenum means supplies non-deleterious fluid to both said tunnel housing means and said air curtain means.

3. An apparatus in accordance with claim 2 in which a first substantially horizontally extending wall of said tunnel housing means is vertically offset from another horizontally extending wall of said tunnel housing means to define a slot therebetween and in which said duct means is formed by said first wall and a second wall spaced therefrom and defining therewith the discharge means for said curtain non-deleterious fluid for sweeping across the bottom of said another wall.

4. An apparatus in accordance with claim 2 in which inlet openings for fluid are formed in one wall of said tunnel housing means at spaced locations for discharging fluid from said plenum means at said spaced locations into said tunnel housing means and in which a means provides a substantially continuous longitudinally extending opening from said plenum means into said air curtain means.

5. An apparatus in accordance with claim 1 in which said tunnel housing means has a top wall supporting said conveyor means, a plenum means for providing air to said housing means includes a longitudinally extending wall common to a vertical side of said tunnel housing, a bottom wall portion of said tunnel housing means comprises a common wall for said air curtain means.

6. A shrouded conveyor apparatus for a booth having a top wall, a longitudinally extending opening for receiving said shrouded conveyor, said shrouded conveyor apparatus comprising a tunnel housing means defining a substantially enclosed tunnel with a bottom, longitudinally extending slot, a conveyor means mounted in said tunnel housing means and having depending hanger means projecting downwardly through said slot and through said opening into said booth and into a deleterious fluid in said booth, a first bottom wall on said housing means extending substantially horizontally and defining one side of said slot, a second bottom wall extending substantially horizontally and defining the other side of said slot and further defining one side of a fluid curtain discharge, a third substantially horizontal wall spaced downwardly from and defining with said second bottom wall a curtain fluid discharge means across the bottom of said first bottom wall, a plenum means for supplying pressurized fluid into said tunnel housing means for flow through said slot and into said curtain discharge means between said second and third bottom walls, a vertically extending side wall of said tunnel housing also forming a vertical side wall for said plenum means, and openings in said vertically extending walls for discharging fluid from said plenum means into said tunnel housing means.

7. A shrouded conveyor means in accordance with claim 6 in which said first bottom wall is offset vertically upwardly of said second bottom wall to facilitate the flow of fluid from said air curtain means across the bottom thereof.

8. A spray chamber comprising an enclosed booth through which articles are conveyed, an overhead conveyor means for conveying articles through the booth and past an article treating station at which airborne vapors or particles are generated, an enclosed housing means for said conveyor means having a bottom slot through which a depending portion of the conveyor extends, means for pressurizing the interior of said housing with clean air and discharging said clean air through said bottom slot, and air curtain means for directing a stream of high velocity air flow laterally across the depending portion of said housing to create an air barrier to the upward flow of the airborne vapors and to sweep laterally any particles dropping through said slot from said conveyor means.

9. For use with a conveyor having elongated support means, roller means movable along the support means, and hanger means carried by the roller means for supporting articles to be conveyed on the conveyor in spaced relationship from the support means; and essentially fluid-impervious shrouding isolating the conveyor support and roller means from the conveyed articles except through a continuous slot paralleling the support means through which the hanger means extends, improved apparatus for keeping environmental fluids ambient the articles from entering the shrouding slot and contacting the conveyor support and roller means, the combination comprising said shrouding having opening means therein for admitting clean fluid that can flow over the conveyor support and roller means and discharge then through the shrouding slot; essentially fluid-impervious housing means defining a plenum having narrow substantially continuous outlet means disposed adjacent one edge of the slot and generally facing the opposite edge of the slot; and means forcing clean fluid to within the housing means plenum for discharge therefrom through said outlet means as a substantially continuous narrow curtain of fluid moving transversely of the slot with sufficient velocity for redirecting the fluid discharge through said shrouding slot transversely of the hanger means for continued common movement therewith in the direction away from the outlet means and avoiding the conveyed articles.

10. Apparatus according to claim 9, wherein said shrouding opening means communicate with said plenum whereby the clean fluid therein also is discharged through said opening means for flow over the conveyor support and roller means and discharge then through the shrouding slot.

11. Apparatus according to claim 9, wherein the volume of fluid discharge from said shrouding slot is of the order of 5 and 25% of the volume of fluid discharge from said plenum outlet means.

12. Apparatus according to claim 9, wherein said plenum outlet means is of the order of $\frac{1}{2}$ and $\frac{3}{4}$ inch wide and wherein said shrouding slot is of the order of 1 and 5 inches wide.

13. Apparatus according to claim 9, wherein the velocity of fluid discharge at the throat of the outlet means is of the order of at least approximately 400 and 800 feet per minute.

14. Apparatus according to claim 9, wherein said one and opposite edges of the shrouding slot are laterally offset from one another with respect to the movement of the curtain of fluid from the outlet means, and wherein the one edge of the slot is closer to the conveyed articles than is the opposite edge of the slot.

15. For use in spray chamber installation including hood means and exhaust means for removing unwanted environmental fluids from proximate the hood means; and conveyor means for conveying articles to be sprayed to within the confines of the hood means for exposure to said environmental fluids, said conveyor means including stationary elongated support means, roller means movable along the support means, and hanger means carried by the roller means for supporting the conveyed articles in spaced relationship from the support means; improved apparatus for keeping the environmental fluids ambient the articles from contacting the conveyor support and roller means, comprising the combination of essentially fluid-impervious shrouding substantially enclosing the conveyor support and roller means and isolating the same from the conveyed articles except through a continuous slot paralleling the support means through which the hanger means extends; essentially fluid-impervious housing means defining a plenum having narrow substantially continuous outlet means disposed adjacent one edge of the slot and generally facing the opposite edge of the slot and the exhaust means; means communicating said housing means plenum with the enclosure generally defined within the shrouding; and means forcing clean fluid to within the housing means plenum for discharge therefrom in part via the shrouding enclosure and through the shrouding slot generally in a direction in line with the hanger means and in part through said outlet means as a substantially continuous narrow curtain of fluid moving transversely of the slot and of the hanger means, and said curtain of fluid having sufficient velocity for redirecting the fluid discharge through said shrouding slot transversely of the hanger means and conveyed articles for continued common movement therewith in the direction generally toward the exhaust means.

16. Apparatus according to claim 15, wherein said one and opposite edges of the shrouding slot are laterally offset from one another with respect to the movement of the curtain of fluid from the outlet means, and wherein the one edge of the slot is closer to the conveyed articles than is the opposite edge of the slot.

17. Apparatus according to claim 16, wherein said plenum outlet means is of the order of $\frac{1}{4}$ and $\frac{3}{4}$ inch wide and wherein said shrouding slot is of the order of 1 and 5 inches wide, and wherein the velocity of fluid discharge at the throat of the outlet means is of the order of at least approximately 400 and 800 feet per minute.

* * * * *